US008705786B2

(12) United States Patent
Akino

(10) Patent No.: US 8,705,786 B2
(45) Date of Patent: Apr. 22, 2014

(54) DYNAMIC MICROPHONE UNIT AND DYNAMIC MICROPHONE

(75) Inventor: Hiroshi Akino, Kanagawa (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 0 days.

(21) Appl. No.: 13/594,121

(22) Filed: Aug. 24, 2012

(65) Prior Publication Data

US 2013/0058515 A1 Mar. 7, 2013

(30) Foreign Application Priority Data

Sep. 1, 2011 (JP) ..... 2011-190567

(51) Int. Cl.
*H04R 9/08* (2006.01)
*H04R 25/00* (2006.01)

(52) U.S. Cl.
USPC ..... 381/355; 381/177

(58) Field of Classification Search
USPC ..... 381/355, 177, 397
See application file for complete search history.

(56) References Cited

U.S. PATENT DOCUMENTS

| | | | | |
|---|---|---|---|---|
| 6,035,052 | A * | 3/2000 | Fujihira et al. | 381/401 |
| 7,088,841 | B2 * | 8/2006 | Kallen | 381/397 |
| 2009/0154753 | A1 * | 6/2009 | Akino | 381/355 |

* cited by examiner

*Primary Examiner* — Brian Ensey
*Assistant Examiner* — Norman Yu
(74) *Attorney, Agent, or Firm* — Whitham Curtis Christofferson & Cook, PC

(57) ABSTRACT

A dynamic microphone unit has a diaphragm 5 vibrating in response to sound waves, a voice coil 6 fixed to the diaphragm 5 and vibrating in cooperation with the diaphragm 5, a magnetic circuit including a magnetic gap around the voice coil 6 and generating a magnetic field in a magnetic gap, a first air chamber 11 adjacent to the reverse of the diaphragm 5 holding an acoustic resistance therein, a second air chamber 9 behind the voice coil, and a communication passage 22 for sound waves between the first air chamber 11 and the second air chamber 9.

4 Claims, 11 Drawing Sheets

DYNAMIC MICROPHONE UNIT AND DYNAMIC MICROPHONE

TECHNICAL FIELD

The present invention relates to a dynamic microphone unit and a dynamic microphone, and in particular, a resonance preventing structure adaptable to a unidirectional dynamic microphone unit.

BACKGROUND ART

Unidirectionality of a unidirectional dynamic microphone is achieved by a combination of an omnidirectional component and a bidirectional component. The omnidirectional component depends on an acoustic resistance, while the bidirectional component depends on a mass control. Implementation of the unidirectionality requires a flat frequency response of the resistance component. A unidirectional dynamic microphone thus includes an acoustic resistor provided immediately behind the diaphragm.

FIG. 8 is a longitudinal cross-sectional view illustrating a typical conventional unidirectional dynamic microphone unit 200. In FIG. 8, a body frame 1 functions as a base of the microphone unit. The body frame 1 functions as a part of a magnetic circuit described below: the body frame 1 serves as an outer yoke. The body frame 1 is a substantially cylindrical member of a magnetic material, and is provided with a center hole. The diameter of the substantially lower half of the center hole is smaller than that of the upper half as shown in FIG. 8. The body frame 1 also has a step on the inner circumference wall in the middle of the vertical direction.

The step in the center hole of the body frame 1 is fixed to a disc yoke 2. The yoke 2 has a disc magnet 3 fixed thereupon. The magnet 3 has a disc pole piece 4 fixed thereupon. The yoke 2, the magnet 3, and the pole piece 4 respectively have center holes 21, 31, and 41 in the same diameter. The body frame 1, the yoke 2, the magnet 3, and the pole piece 4 are connected to each other by bonding. The body frame 1 serves as the outer yoke as described above, while the yoke 2 serves as an inner yoke. The outer circumference wall of the yoke 2 is in close contact with the inner circumference wall of the body frame 1. A circular gap in a plan view is defined between the outer circumference wall of the pole piece 4 and the inner circumference wall of the body frame 1. A magnetic flux originated from the magnet 3 passes through a magnetic circuit consisting of the yoke 2, the body frame 1 serving as the outer yoke, the gap, and the pole piece 4, and returning to the magnet 3, which allows the gap to function as a magnetic gap. The outer diameter of the magnet 3 is smaller than that of the pole piece 4, which defines an air chamber 9 surrounding the magnet 3, the air chamber 9 having a larger width compared to the magnetic gap and located beneath the magnetic gap.

The top end of the body frame 1 is surrounded by a cylindrical member 35 fixed thereto. The top end of the cylindrical member 35 includes an internal flange 36 on the inner circumference wall. The flange 36 is fixed to the outer circumference wall of the top end of the body frame 1 by, for example, bonding. The flange 36 has a plurality of vertical through holes 37. A cylindrical space between the inner circumference wall of the cylindrical member 35 and the outer circumference wall of the body frame 1 is in communication with a space above the cylindrical member 35 through the holes 37. The tops of the holes 37 are covered with an acoustic resistor 18.

The diaphragm 5 has an outer peripheral edge fixed to the top end of the cylindrical member 35. The diaphragm 5 consists of a center dome 51 and a sub dome 52 surrounding the center dome 51 that are produced by shaping a thin film of a synthetic resin or metal. The center dome 51 has a partially spherical shape. The sub dome 52 has a partially arc-shaped cross-section and surrounds the peripheral edge of the center dome 51. The sub dome 52 has an outer peripheral edge fixed to the outer peripheral edge of the cylindrical member 35. The diaphragm 5 including such a sub dome 52 is fixed to the cylindrical member 35, the outer peripheral edge of the sub dome 52 being the fixed point as described above. Upon receipt of sound waves, the diaphragm 5 can vibrate in the anteroposterior direction (in the vertical direction in FIG. 8) in response to sound pressure, the fixed point or the outer peripheral edge of the sub dome 52 functioning as a node.

The diaphragm 5 has a voice coil 6 fixed along a boundary between the center dome 51 and the sub dome 52. The voice coil 6 is a fine wire wound into a cylindrical shape and fixed to maintain a steady shape. The first end of the cylindrical voice coil 6 is fixed to the diaphragm 5. While the outer peripheral edge of the sub dome 52 of the diaphragm 5 is fixed in such a manner as described above, the voice coil 6 is located in the magnetic gap. The voice coil 6 is separated from the body frame 1 and the pole piece 4. The sub dome 52 of the diaphragm 5 covers the tops of the holes 37 of the cylindrical member 35 and the upper surface of the acoustic resistor 18.

Adjacent to the reverse of the diaphragm 5 (beneath the diaphragm 5 in FIG. 8), a protector 7 is fixed to the top of the pole piece 4. The protector 7 has a dome top portion. The protector 7 keeps a certain distance from the center dome 51 of the diaphragm 5. The protector 7 has a center hole 71 in communication with the center holes 41, 31, and 21 of the pole piece 4, the magnet 3, and the yoke 2, respectively.

Adjacent to the obverse of the diaphragm 5, an equalizer 8, which serves as a protector for the diaphragm 5, is located. The outer peripheral edge of the equalizer 8 is fixed to the outer peripheral edge of the top end of the cylindrical member 35. The equalizer 8 has a dome ceiling in the center. The equalizer 8 keeps a certain distance from the center dome 51 of the diaphragm 5. The equalizer 8 has a center hole 81 and a plurality of holes 82 around the center hole 81 through which sound waves propagate from the outside to the diaphragm 5.

An opening at the bottom end of the body frame 1 is covered by a cap 10, which defines a relatively large air chamber 11 at the bottom end of the body frame 1. The air chamber 11 holds an acoustic resistor 12 of a thickly-layered nonwoven fabric therein. The acoustic resistor 12 is disposed adjacent to the reverse of the diaphragm 5. Such a configuration provides a unidirectional dynamic microphone unit.

Upon receipt of sound waves, the diaphragm 5 vibrates in the anteroposterior direction in response to changes in sound pressure. The vibration of the diaphragm 5 induces anteroposterior vibration of the voice coil 6. During the vibration, the voice coil 6 moves in the magnetic flux across the magnetic gap. The voice coil 6 moving in the magnetic flux generates voice signals in response to changes in sound pressure. The dynamic microphone unit electro-acoustically converts the signals as described above. The voice signal is output, for example, from the both ends of the voice coil 6 fixed along the inner peripheral edge of the rear surface of the sub dome 52.

The microphone unit having the configuration described above resonates with acoustic masses and acoustic capacitances formed at various sites. The cause of resonance is described below. The magnet gap defined between the inner circumference wall of the body frame 1, which serves as the outer yoke, and the outer circumference wall of the pole piece 4 is as small as possible, provided that the voice coil 6 does not come into contact with the surrounding portions. Such a small magnetic gap is provided to increase the magnetic flux density in the magnetic gap in order to achieve high sensitivity of a microphone. The voice coil 6 thus substantially partitions a space adjacent to the reverse of the diaphragm 5 into an acoustic capacitance space Sc adjacent to the reverse of the center dome 51 and an acoustic capacitance space Ss adjacent to the reverse of the sub dome 52.

The voice coil 6 partitions each of the acoustic mass and the acoustic resistance of the magnetic gap into an inner section and an outer section. An acoustic mass mgi and an acoustic resistance rgi are generated in the inner section or a space between the inner circumference wall of the voice coil 6 and the outer circumference wall of the pole piece 4. An acoustic mass mgo and an acoustic resistance rgo are generated in the outer section or a space between the outer circumference wall of the voice coil 6 and the inner circumference wall of the body frame 1 serving as the outer yoke. The air chamber 9 between the inner circumference wall of the body frame 1 and the outer circumference wall of the magnet 3 holds an acoustic capacitance Sg. The acoustic capacitance space Sc is in communication with the acoustic capacitance space Ss through the acoustic mass mgi, the acoustic resistance rgi, the acoustic capacitance Sg, the acoustic mass mgo, and the acoustic resistance rgo.

The obverse of the diaphragm 5 undergoes a sound pressure P1. The acoustic resistor 12 disposed in the air chamber 11 of the body frame 1 has an acoustic resistance r1. The air chamber 11 holds an acoustic capacitance S1. The hole 37, which extends vertically through the flange 36 of the cylindrical member 35 and is in contact with the acoustic capacitance space Ss adjacent to the reverse of the sub dome 52, has an acoustic mass m1. The sound waves propagating through the hole 37 has a sound pressure P2. The acoustic resistor 18 between the hole 37 and the acoustic capacitance space Ss holds an acoustic resistance r2. The air chamber adjacent to the obverse of the diaphragm 5 holds an acoustic mass mo and an acoustic capacitance So.

FIG. 10 shows an equivalent circuit of the microphone unit illustrated in FIG. 8, the microphone unit having the acoustic mass, the acoustic capacitance, and the acoustic resistance as described above. In FIG. 10, the sound pressure P1, the acoustic mass mo, the acoustic capacitance So, the acoustic mass mgi, the acoustic resistance rgi, the acoustic resistance rgo, the acoustic mass mgo, the acoustic mass m1, the acoustic resistance r2, and the sound pressure P2 are in series connection. A node between the acoustic capacitance So and the acoustic mass mgi and a first node between the sound pressure P1 and the sound pressure P2 are connected to the acoustic capacitance Sc. These nodes are also connected to the acoustic resistance r1 and the acoustic capacitance S1 that are in series connection. A node between the acoustic resistance rgi and the acoustic resistance rgo and a second node between the sound pressure P1 and the sound pressure P2 are connected to the acoustic capacitance Sg. A node between the acoustic mass mgo and the acoustic mass m1 and a third node between the sound pressure P1 and the sound pressure P2 are connected to the acoustic capacitance Ss.

FIG. 10 demonstrates that the acoustic mass mgi of the inner section of the magnetic gap partitioned by the voice coil 6 and the acoustic capacitance Sg of the air chamber 9 define a resonance circuit. The acoustic mass mgo of the outer section of the magnetic gap and the acoustic capacitance Ss of the space adjacent to the reverse of the sub dome 52 also define a resonance circuit. The volume of the air chamber 9 is smaller than the air chamber 11 at the half bottom of the body frame 1. The acoustic capacitance Sg of the air chamber 9 readily causes a resonance in cooperation with the acoustic mass mgi.

FIG. 11 is a spectrum representing frequency characteristics of observed sound waves from the microphone unit forming such a resonance, i.e., frequency characteristics of the sound waves from an angle of 0° with respect to the microphone unit or from the direct front of the microphone unit, the sound waves from an angle of 90° with respect to the microphone unit or from just beside of the microphone unit, and the sound waves from an angle of 180° with respect to the microphone unit or from immediately behind the microphone unit. FIG. 11 evidently shows that the sound waves that have respective angles with respect to the microphone unit achieve resonance peak at a specific frequency, which leads to unsatisfactory frequency characteristics. A unidirectional microphone desirably outputs signals at a flat level over a wide frequency range from low frequency to high frequency. The conventional unidirectional microphone outputs signals at variable levels depending on the frequency as shown in FIG. 11. The microphone having such frequency characteristics may provide uneven directivity, and convert sound waves from a specific direction into electrical signals representing different sound tones.

A possible measure to prevent such a resonance with the acoustic mass mgi is a further reduction in volume of the air chamber 9 to minimize the acoustic capacitance Sg. The typical conventional dynamic microphone unit 300 illustrated in FIG. 9 includes such an extremely small air chamber. The microphone unit 300 has a spacer 15 surrounding the magnet 3. Like the typical conventional dynamic microphone unit illustrated in FIG. 8, the dynamic microphone unit 300 illustrated in FIG. 9 has the air chamber 9 between the outer circumference wall of the magnet 3 and the inner circumference wall of the body frame 1, but the most part of the air chamber 9 is filled with the spacer 15. The outer circumference wall of the half of the top end of the spacer 15 is cut away to form a step. The step faces the bottom end of the voice coil 6 and keeps a distance from the voice coil 6, and the distance functions as a clearance for the stroke of the voice coil 6. The step of the spacer 15 defines a space corresponding to the air chamber 9 having an extremely small volume. Such an air chamber 9 thus holds an extremely small acoustic capacitance, which prevents a resonance with the acoustic mass mgi.

Contrarily, an effective measure to improve the sensitivity of a microphone unit is an increase in an effective area of the diaphragm 5 or the main dome 51. As the area of the dome 51 increases, the diameter of the voice coil 6 increases, which expands the stroke of the diaphragm 5 or the voice coil 6. Accordingly, the air chamber 9 accommodating the voice coil 6 must have larger volume, which hinders the reduction of the acoustic capacitance Sg of the air chamber 9. The typical conventional microphone unit illustrated in FIG. 9 having an outer diameter of, for example, about 40 mm limits the reduction in the volume of the air chamber 9. Hence, the typical conventional microphone unit illustrated in FIG. 9 cannot effectively prevent the resonance caused by the acoustic mass mgi and the acoustic capacitance Sg.

A microphone unit described in Japanese Unexamined Patent Application Publication No. H11-275680 includes a frame yoke having an opening as a directivity circuit on a flange portion. Behind the opening, a small-volume air chamber is disposed via a directivity resistor, the air chamber having a front side, which opens to and faces the opening, and a back side having a small opening. Such a configuration defines a resonance circuit. The resonance circuit causes a resonance at a target frequency, which reduces the acoustic impedance of the directivity circuit, and increases sound pressure difference between 0° characteristics or front characteristics and 180° characteristics or rear characteristics in order to avoid howling.

SUMMARY OF INVENTION

Technical Problem

According to the conventional dynamic microphone unit, the air chamber behind the voice coil, as well as the voice coil and the acoustic mass of the magnetic gap around the voice coil, causes a resonance and provides unsatisfactory frequency characteristics as described above.

To address the problem, the present invention intends to provide an elaborate dynamic microphone unit that has a configuration including an air chamber provided behind a voice coil and not causing resonance in order to obtain satisfactory frequency characteristics and also to provide a dynamic microphone including the microphone unit.

Solution to Problem

The dynamic microphone unit according to the present invention is characterized by a diaphragm vibrating in response to sound waves; a voice coil fixed to the diaphragm and vibrating in cooperation with the diaphragm; a magnetic circuit comprising an inner yoke, an outer yoke and a pole piece, the magnetic circuit generating a magnetic field in a magnetic gap, and the voice coil being disposed in the magnetic gap; a first air chamber adjacent to a reverse of the diaphragm and holding an acoustic resistance therein; a second air chamber behind the voice coil; and a communication passage for sound waves between the first air chamber and the second air chamber, the communication passage comprising a groove provided on the inner yoke, wherein the magnetic gap is defined between an inner circumference wall of the outer yoke and an outer circumference wall of the pole piece.

DESCRIPTION OF EMBODIMENTS

Figure 8:
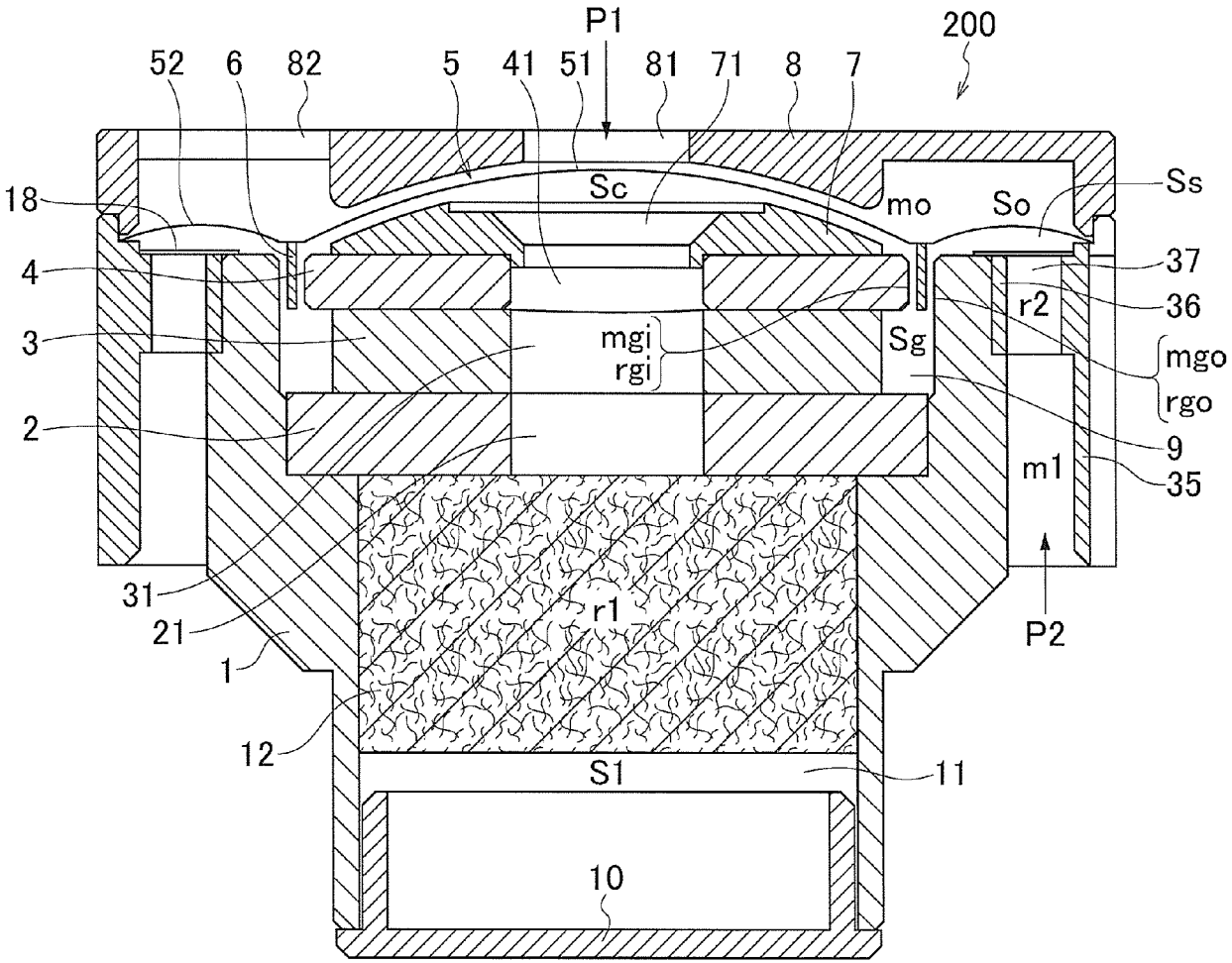
FIG. 8 (Related Art)
FIG. 8 is a longitudinal cross-sectional view of a typical conventional dynamic microphone unit.
Figure 9:
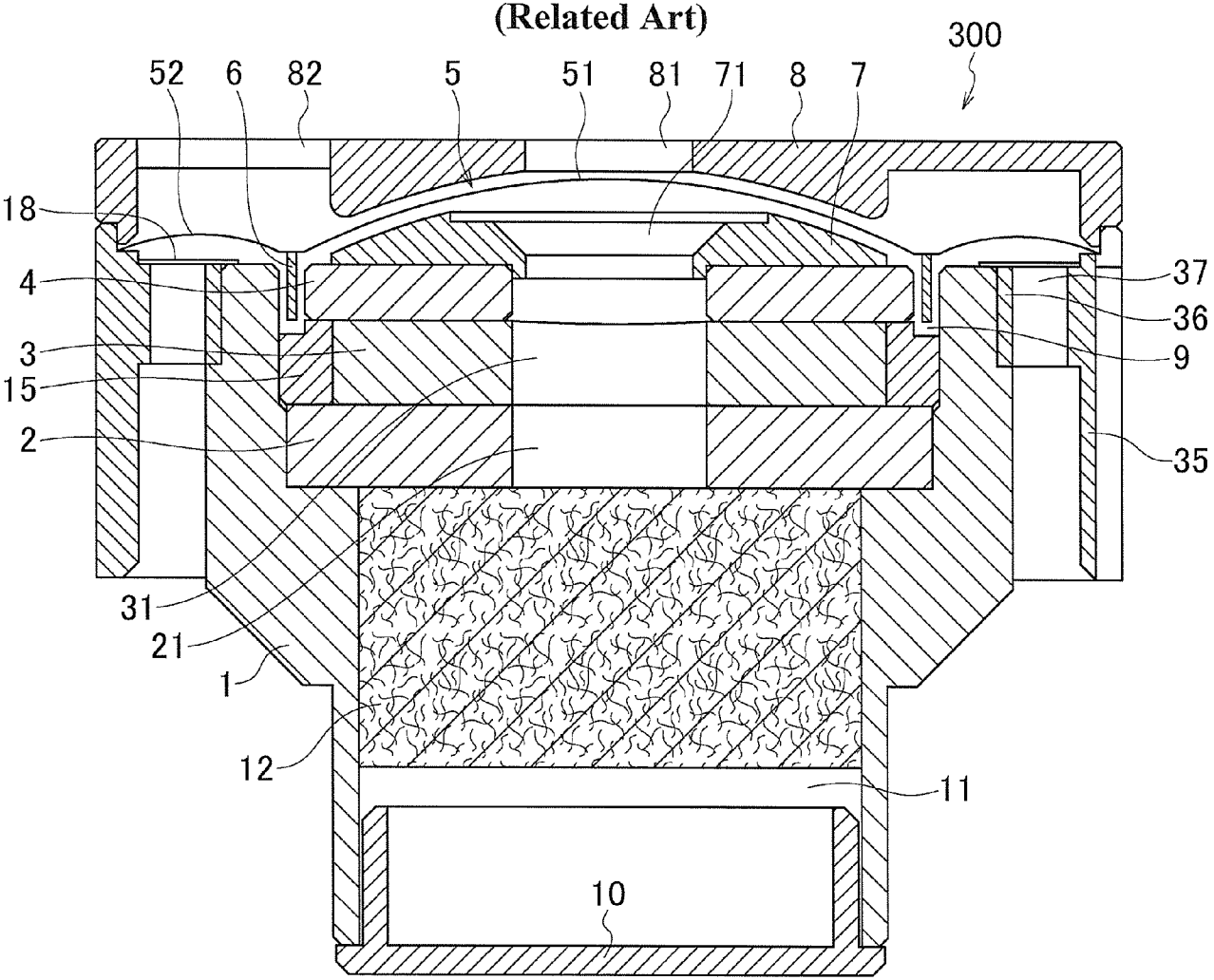
FIG. 9 (Related Art)
FIG. 9 is a longitudinal cross-sectional view of the other typical conventional dynamic microphone unit.

A typical dynamic microphone unit according to the present invention will be now described referring to FIG. 1 through FIG. 7. A dynamic microphone according to the present invention will be also described. The same numerals are assigned to the same components as those of the conventional dynamic microphone units shown in FIGS. 8 and 9.

Embodiments

Figure 1:
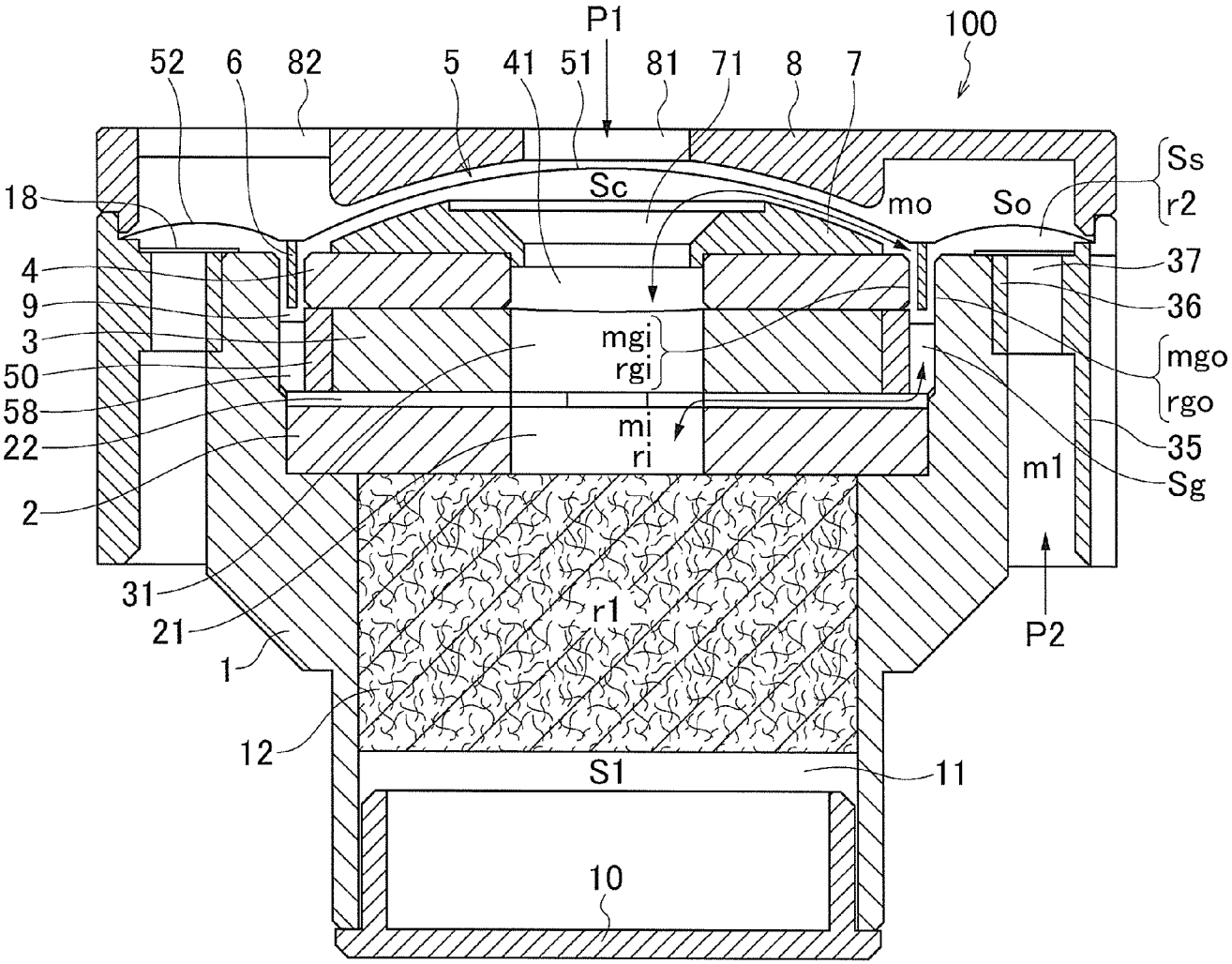
FIG. 1 is a longitudinal cross-sectional view of a typical dynamic microphone unit according to an embodiment of the present invention.

FIG. 1 is a longitudinal cross-sectional view illustrating a typical dynamic microphone unit 100 according to an embodiment the present invention. In FIG. 1, a body frame 1 functions as a base of the microphone unit. The body frame 1 functions as a part of a magnetic circuit: the body frame 1 serves as an outer yoke. The body frame 1 is a substantially cylindrical member of a magnetic material, and is provided with a center hole. The diameter of the substantially lower half of the center hole is smaller than that of the upper half as shown in FIG. 1. The body frame 1 also has a step on the center hole in the middle of the vertical direction.

The step in the center hole of the body frame 1 is fixed to an inner disc yoke 2. The inner yoke 2 has a disc magnet 3 fixed thereupon. The magnet 3 has a disc pole piece 4 fixed thereupon. The inner yoke 2, the magnet 3, and the pole piece 4 respectively have center holes 21, 31, and 41 in the same diameter. The body frame 1, the inner yoke 2, the magnet 3, and the pole piece 4 are connected to each other by bonding. The outer circumference wall of the inner yoke 2 is in close contact with the inner circumference wall of the body frame 1. A circular gap in a plan view is defined between the outer circumference wall of the pole piece 4 and the inner surface of the body frame 1. A magnetic flux originated from the magnet 3 passes through the magnetic circuit comprising of the inner yoke 2, the body frame 1 serving as the outer yoke, the gap, and the pole piece 4, and returning to the magnet 3, which allows the gap to function as a magnetic gap.

Figure 4:
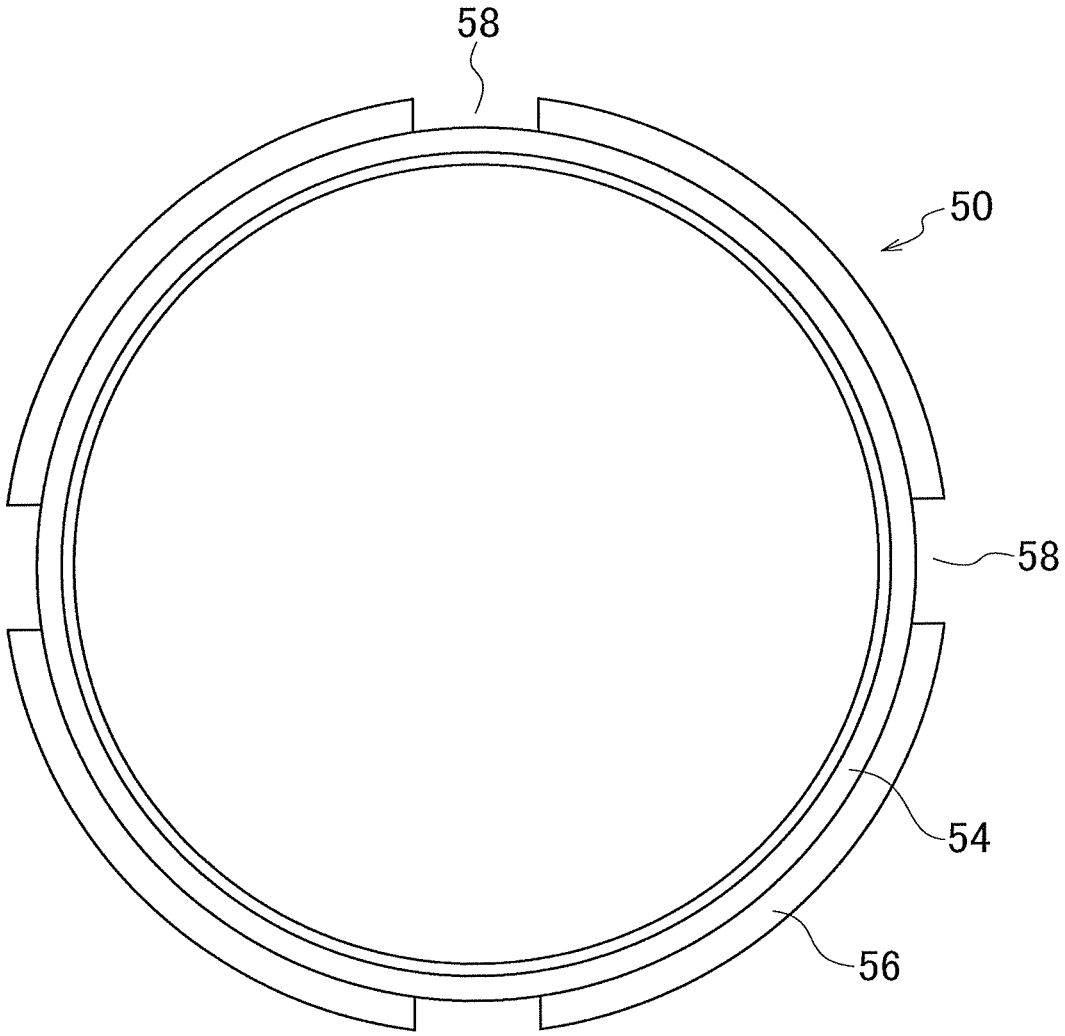
FIG. 4 is a plan view of a spacer of the typical dynamic microphone unit illustrated in FIG. 1.
Figure 5:
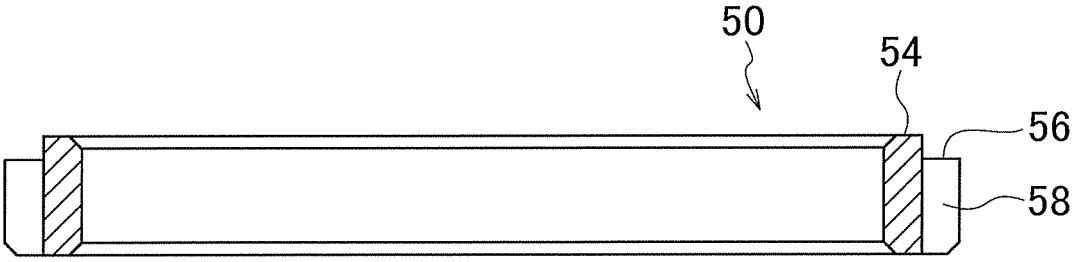
FIG. 5 is a longitudinal cross-sectional view of the spacer illustrated in FIG. 4.

The outer diameter of the magnet 3 is smaller than that of the pole piece 4. A second air chamber 9 has a circular shape in a plan view and is defined between the outer circumference wall of the magnet 3 and the inner circumference wall of the body frame 1. The second air chamber 9 has a ring spacer 50 disposed therein. FIG. 4 is a plan view of the spacer 50. FIG. 5 is a longitudinal cross-sectional view of the spacer 50. The outer peripheral edge of the top end of the ring spacer 50 is cut away to form a lower step 56 as illustrated in FIGS. 4 and 5. The inner peripheral edge of the spacer 50 forms a higher step 54 having substantially the same thickness (vertical dimension) as the magnet 3. The spacer 50 has four notches 58 at regular intervals in the circumferential direction on the outer circumference wall. The notch 58 radially cut into the spacer 50 by the radial thickness of the lower step 56. The inner circumference wall of the spacer 50 is in contact with the outer circumference wall of the magnet 3. The outer circumference wall of the spacer 50 is in contact with the inner circumference wall of the body frame 1. A limited space above the lower step 56 of the spacer 50 thus corresponds to the second air chamber 9 having a small volume. The air chamber 9 is in communication with the notches 58 of the spacer 50.

The top end of the body frame 1 is surrounded by a cylindrical member 35 fixed thereto. The top end of the cylindrical member 35 includes an internal flange 36 on the inner circumference wall. The flange 36 is fixed to the outer circumference of the top end of the body frame 1 by, for example, bonding. The cylindrical member 35 substantially functions as a part of a body frame 1. The internal flange 36 has a plurality of vertical through holes 37. A cylindrical space between the inner circumference wall of the cylindrical member 35 and the outer circumference wall of the body frame 1 is in communication with a space above the cylindrical member 35 through the holes 37. The tops of the holes 37 are covered with an acoustic resistor 18.

The diaphragm 5 has an outer peripheral edge fixed to the top end of the cylindrical member 35 which substantially functions as a part of the body frame 1. The diaphragm 5 consists of a center dome 51 and a sub dome 52 surrounding the center dome 51 that are produced by shaping a thin film of a synthetic resin or metal. The center dome 51 has a partially spherical shape. The sub dome 52 has a partially arc-shaped cross-section and surrounds the peripheral edge of the center dome 51 to be integrated thereto. The sub dome 52 has the outer peripheral edge fixed to the outer peripheral edge of the cylindrical member 35. The diaphragm 5 including such a sub dome 52 is fixed to the cylindrical member 35, the outer peripheral edge of the sub dome 52 being the fixed point as described above. Upon receipt of sound waves, the diaphragm 5 can vibrate in the anteroposterior direction (in the vertical direction in FIG. 1) in response to sound pressure, the fixed point or the outer peripheral edge of the sub dome 52 functioning as a node.

The diaphragm 5 has a voice coil 6 fixed along a boundary between the center dome 51 and the sub dome 52. The voice coil 6 is a fine wire wound into a cylindrical shape and fixed to maintain a steady shape. The first end of the cylindrical voice coil 6 is fixed to the diaphragm 5. While the outer peripheral edge of the sub dome 52 of the diaphragm 5 is fixed in such a manner as described above, the voice coil 6 is provided into the magnetic gap. The voice coil 6 is separated from the body frame 1 and the pole piece 4. The sub dome 52 of the diaphragm 5 covers the tops of the holes 37 of the cylindrical member 35 and the upper surface of the acoustic resistor 18.

Adjacent to the reverse of the diaphragm 5 (beneath the diaphragm 5 in FIG. 1), a protector 7 is fixed to the top of the pole piece 4. The protector 7 has a dome top portion. The protector 7 keeps a certain distance from the center dome 51 of the diaphragm 5. The protector 7 has a center hole 71 in communication with the center holes 41, 31, and 21 of the pole piece 4, the magnet 3, and the yoke 2, respectively.

At the obverse of the diaphragm 5, an equalizer 8, which serves as a protector for the diaphragm 5, is located. The outer peripheral edge of the equalizer 8 is fixed to the outer peripheral edge of the top end of the cylindrical member 35. The equalizer 8 has a dome ceiling in the center. The equalizer 8 keeps a certain distance from the center dome 51 of the diaphragm 5. The equalizer 8 has a center hole 81 and a plurality of holes 82 around the center hole 81 through which sound waves propagate from the outside to the diaphragm 5.

An opening at the bottom end of the body frame 1 is sealed by a cap 10, which defines a relatively large first air chamber 11 in the body frame 1. The first air chamber 11 holds an acoustic resistor 12 of a thickly-layered nonwoven fabric. The acoustic resistor 12 is disposed adjacent to the reverse of the main dome 51 of the diaphragm 5. The second air chamber 9 is in communication with the outside through the magnetic gap at the outer circumferential side of the voice coil 6, the space adjacent to the reverse of the sub dome 51 of the diaphragm 5, an acoustic resistor 18, the hole 37 of the cylindrical member 35, and the space between the inner circumference wall of the cylindrical member 35 and the outer circumference wall of the body frame 1. Such a configuration provides a unidirectional dynamic microphone unit 100. The dynamic microphone unit according to the present invention may have any dimensions, but the typical dynamic microphone unit illustrated in the attached drawings includes the equalizer 8 having an outer diameter of 40 mm.

Figure 2:
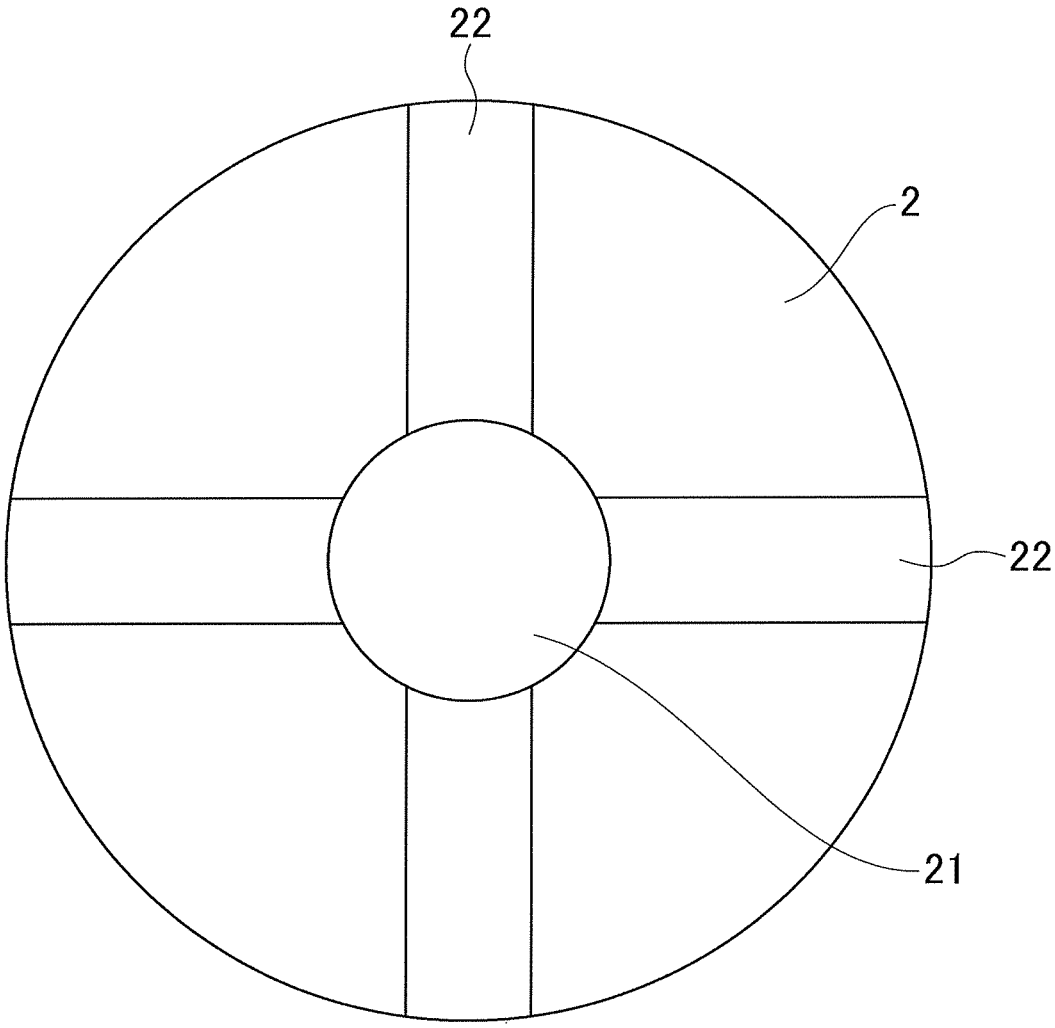
FIG. 2 is a plan view of an inner yoke of the typical dynamic microphone unit illustrated in FIG. 1.
Figure 3:
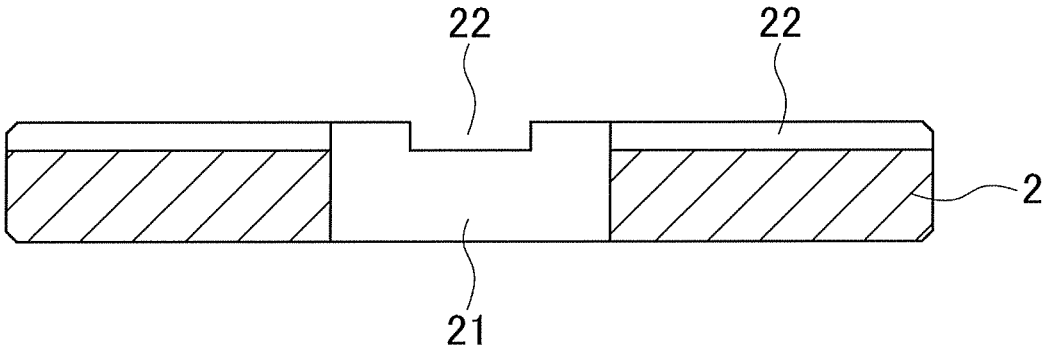
FIG. 3 is a longitudinal cross-sectional view of the yoke illustrated in FIG. 2.

The dynamic microphone unit according to the present invention is characterized in that a communication passage for sound waves is defined between the first air chamber 11 and the second air chamber 9. The communication passage is defined by an inventive design of the inner yoke 2. The inner yoke 2 includes grooves 22 extending in the radial direction on the surface facing the magnet 3 (the upper surface in FIG. 1) as illustrated in FIG. 2 and FIG. 3. The inner yoke 2 has four of the grooves 22 formed at regular intervals in the circumferential direction. Each groove 22 extends such that the outer circumference wall of the inner yoke 2 is in communication with the center hole 21. The grooves 22 of the inner yoke 2 are aligned with the notches 58 of the spacer 50. Such an alignment allows the space in the groove 22 to be in communication with the space in the notch 58. The upper surface of the inner yoke 2 is in contact with the bottom surface of the magnet 3. The groove 22 between the inner yoke 2 and the magnet 3 defines a communication passage. The communication passage is also in communication with the first air chamber 11 and the second air chamber 9 through the notch 58 of the spacer 50.

Both the groove 22 of the inner yoke 2 and the notch 58 have rectangular cross-sections of substantially the same area. The total cross-sectional area of the grooves 22 is substantially equal to the area of the gap between the inner circumference wall of the voice coil 6 and the outer circumference wall of the pole piece 4 in a plan view where the acoustic mass mgi and the acoustic resistance rgi are generated, and the area of the gap between the outer circumference wall of the voice coil 6 and the inner circumference wall of the body frame 1 in a plan view where the acoustic mass mgo and the acoustic resistance rgo are generated.

Upon receipt of sound waves, the diaphragm 5 vibrates in the anteroposterior direction in response to changes in sound pressure. The vibration of the diaphragm 5 induces anteroposterior vibration of the voice coil 6. During the vibration, the voice coil 6 moves in the magnetic flux across the magnetic gap. The voice coil 6 moving in the magnetic flux generates voice signals in response to changes in sound pressure. The dynamic microphone unit 100 electro-acoustically converts the signals as described above. The voice signals are output, for example, from the both ends of the voice coil 6 fixed along the inner peripheral edge of the rear surface of the sub dome 52.

Figure 6:
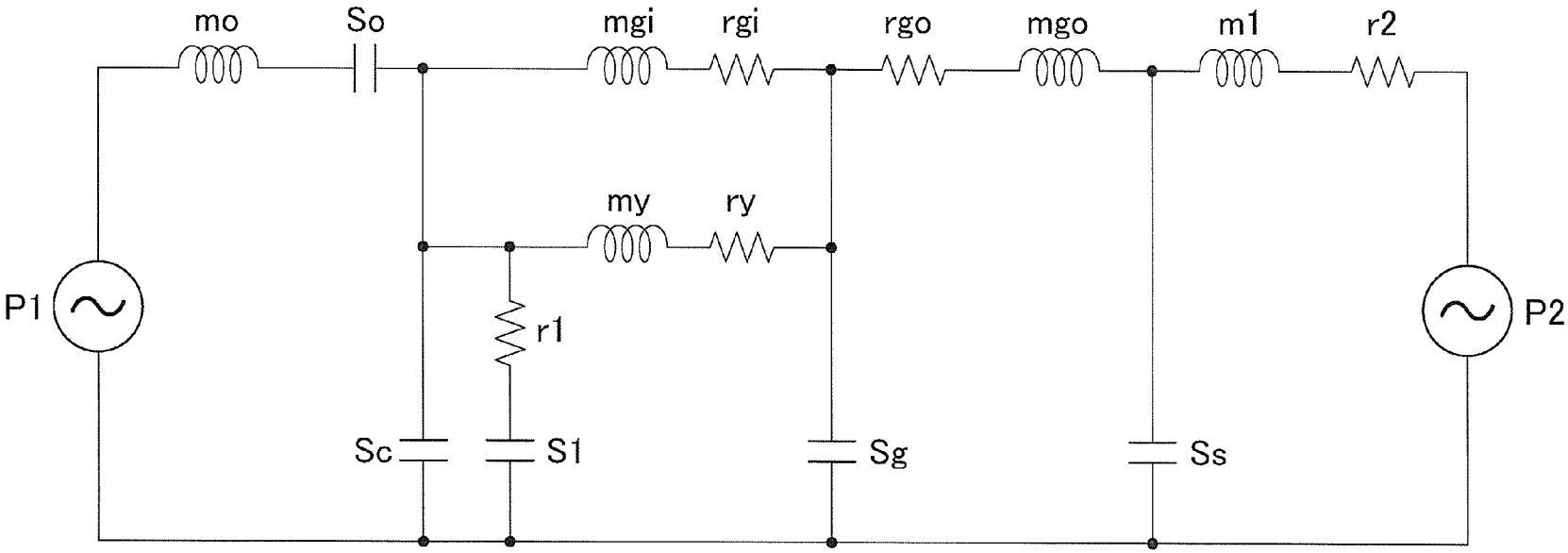
FIG. 6 is an equivalent circuit diagram of the typical dynamic microphone unit illustrated in FIG. 1.

FIG. 6 shows an equivalent circuit of the typical dynamic microphone unit according to the present invention. In FIG. 6, the sound pressure P1, the acoustic mass mo, the acoustic capacitance So, the acoustic mass mgi, the acoustic resistance rgi, the acoustic resistance rgo, the acoustic mass mgo, the acoustic mass m1, the acoustic resistance r2, and the sound pressure P2 are in series connection. A node between the acoustic capacitance So and the acoustic mass mgi and a first node between the sound pressure P1 and the sound pressure P2 are connected to the acoustic capacitance Sc. These nodes are also connected to the acoustic resistance r1 and the acoustic capacitance S1 that are in series connection. A node between the acoustic resistance rgi and the acoustic resistance rgo and a second node between the sound pressure P1 and the sound pressure P2 are connected to the acoustic capacitance Sg. A node between the acoustic mass mgo and the acoustic mass m1 and a third node between the sound pressure P1 and the sound pressure P2 are connected to the acoustic capacitance Ss. The configuration of the equivalent circuit described above is same as that of the conventional dynamic microphone unit illustrated in FIG. 10.

Figure 10:
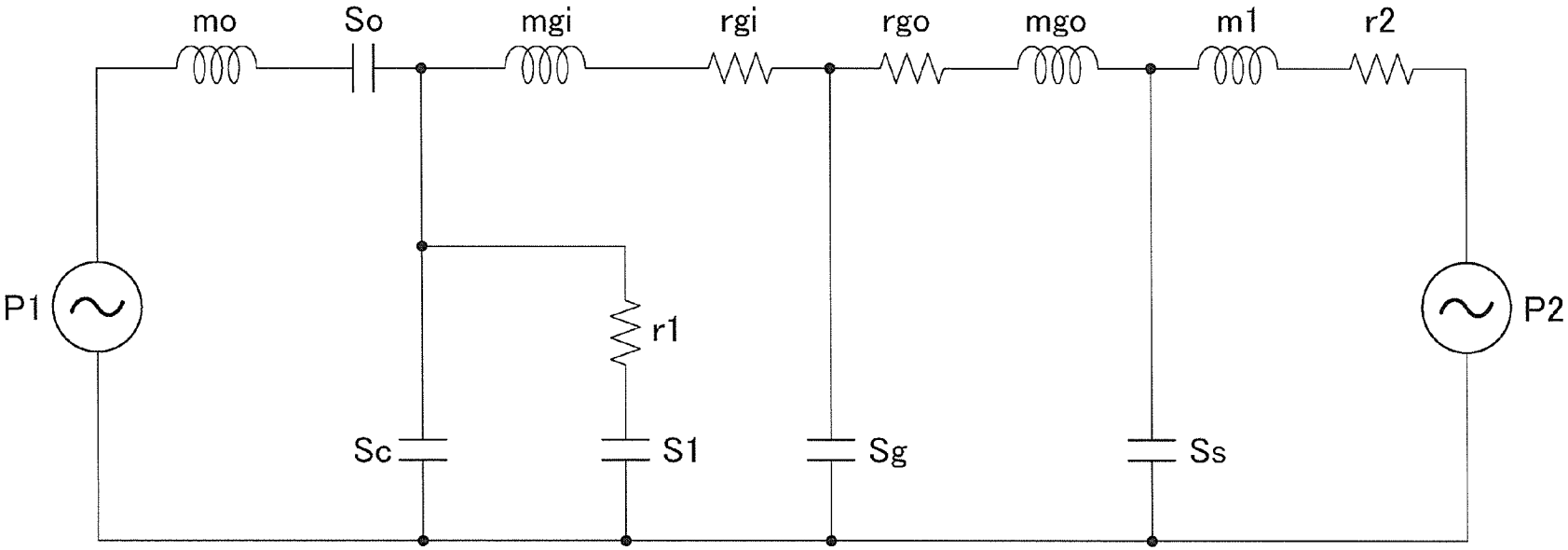
FIG. 10 (Related Art)
FIG. 10 is an equivalent circuit diagram of the conventional dynamic microphone unit.
Figure 11:
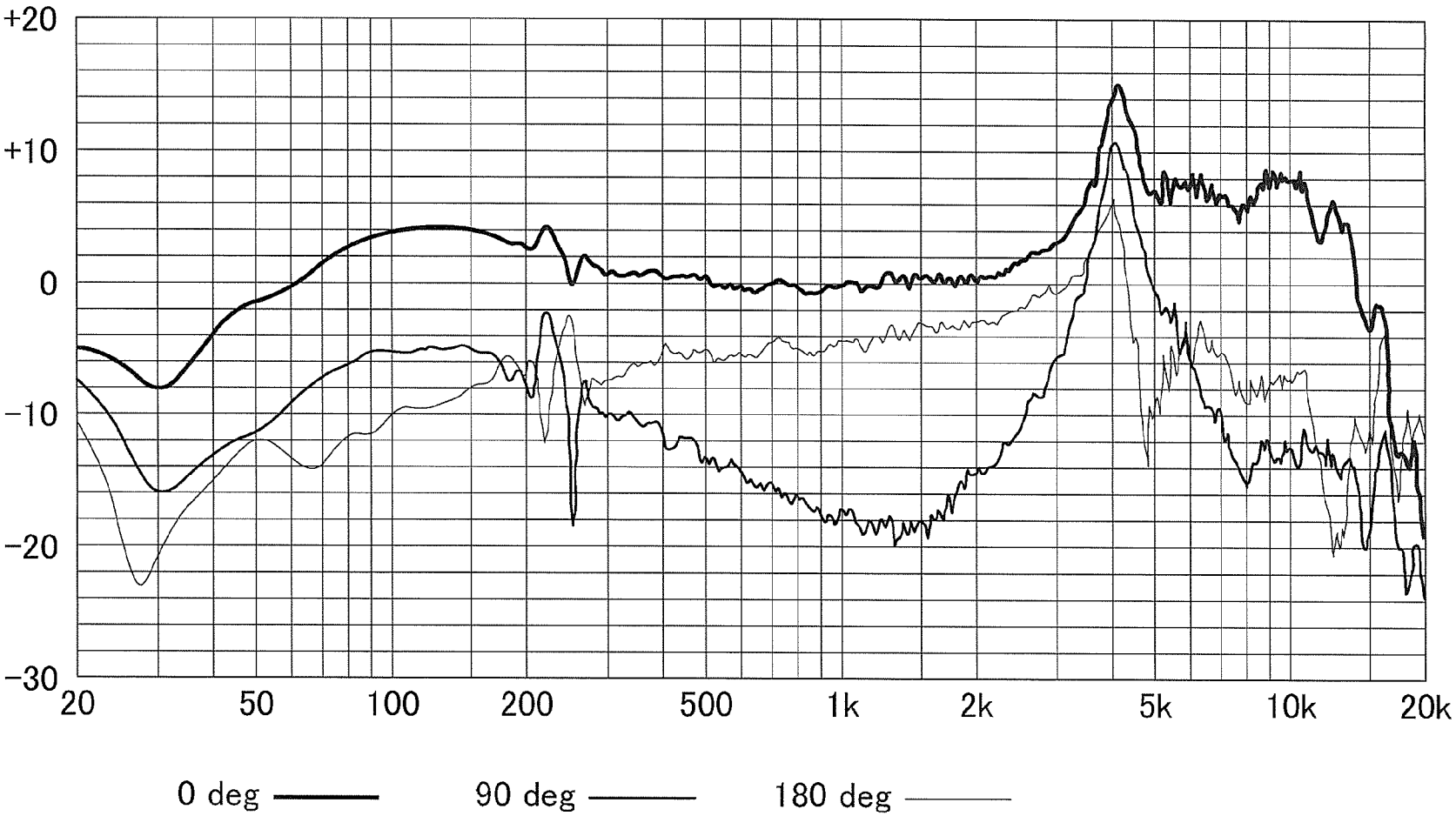
FIG. 11 (Related Art)
FIG. 11 is a spectrum representing frequency characteristics of the conventional dynamic microphone unit.

The equivalent circuit of the typical dynamic microphone unit according to the present invention, which is illustrated in FIG. 6, is different from the conventional equivalent circuit of the typical conventional dynamic microphone unit, which is illustrated in FIG. 10, in that the acoustic mass mgi and the acoustic resistance rgi that are in series connection are in parallel connection with the acoustic mass my and the acoustic resistance ry that are in series connection. The communication passage between the first air chamber 11 and the second air chamber 9 or the space in the groove 22 of the inner yoke 2 holds an acoustic mass my. The communication passage also holds an acoustic resistance ry. FIG. 1 demonstrates that the communication passage bypasses the gap between the inner circumference wall of the voice coil 6 and the outer circumference wall of the pole piece 4. Likewise, the equivalent circuit diagram shown in FIG. 6 represents that the acoustic mass mgi and the acoustic resistance rgi generated in the gap between the inner circumference wall of the voice coil 6 and the outer circumference wall of the pole piece 4 is bypassed by the acoustic mass my and the acoustic resistance ry generated in the communication passage.

As described above, according to the conventional dynamic microphone unit 200, the acoustic mass mgi of the inner section partitioned by the voice coil 6 and the acoustic capacitance Sg of the air chamber 9 define a resonance circuit, which provides unsatisfactory acoustic characteristics. Contrarily, according to the typical dynamic microphone unit 100 of the present invention, the acoustic mass mgi and the acoustic resistance rgi that are in series connection are in parallel connection with the acoustic mass my and the acoustic resistance ry of the communication passage that are in series connection. Such a connection of the circuit of the dynamic microphone unit 100 thus allows the series connection between the acoustic mass mgi and the acoustic resistance rgi to be short-circuited by the series connection between the acoustic mass my and the acoustic resistance ry. The acoustic mass my and the acoustic resistance ry, therefore, prevent the resonance due to the acoustic mass mgi and the acoustic capacitance Sg.

Figure 7:
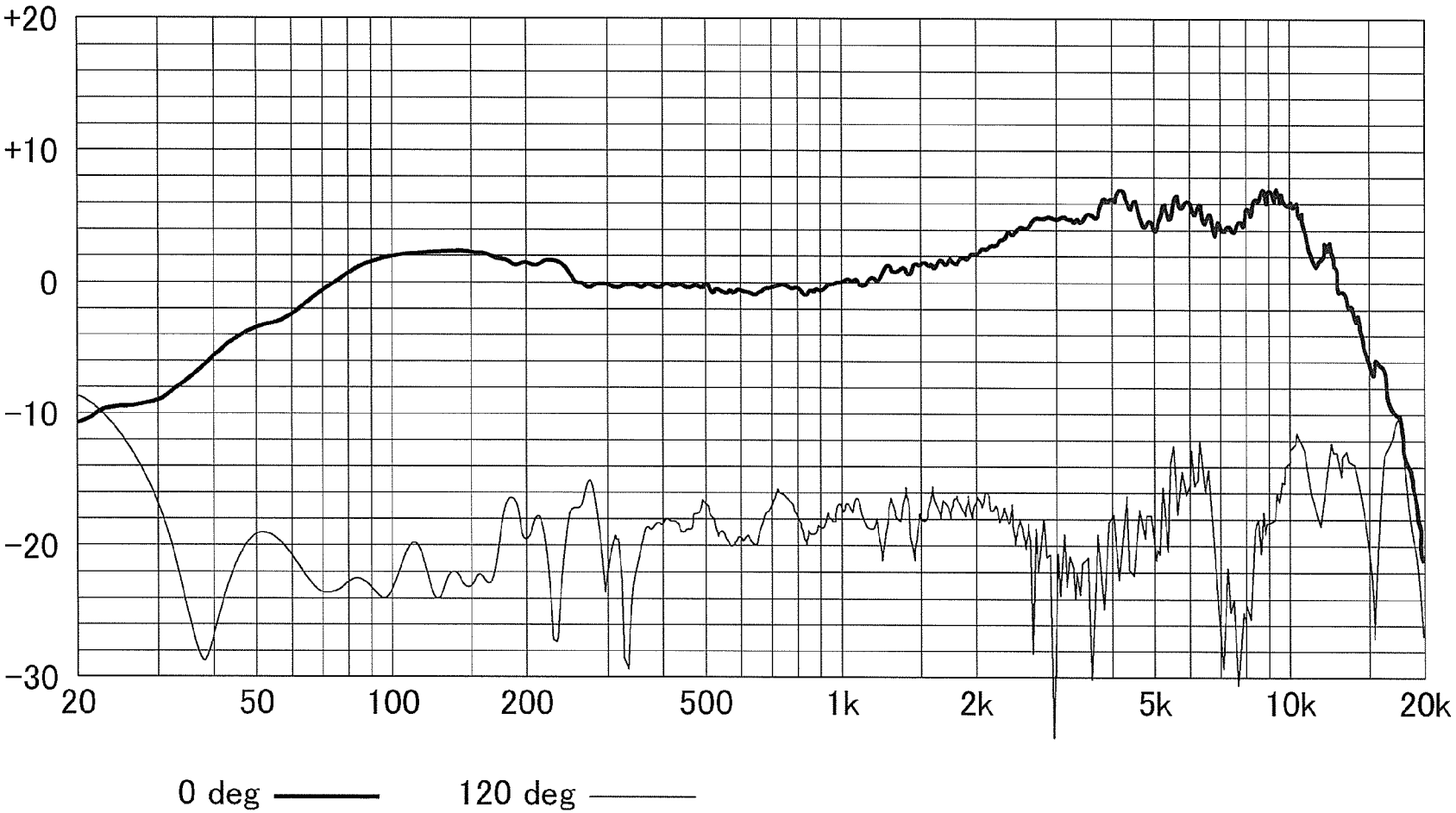
FIG. 7 is a spectrum representing frequency characteristics of the typical dynamic microphone unit illustrated in FIG. 1.

FIG. 7 is a spectrum representing frequency characteristics of the dynamic microphone unit according to an embodiment of the present invention, i.e., frequency characteristics of the sound waves from the immediately front of the microphone unit or from an angle of 0° with respect to the microphone unit and the sound waves from an angle of 120° with respect to the microphone unit. FIG. 7 evidently shows that the dynamic microphone unit 100 can provide satisfactory frequency characteristics without resonance peak over the overall frequency range. The dynamic microphone unit 100 also allows sound waves from an angle of 120° to provide frequency characteristics holding at a stable output level without resonance peak over the overall frequency range. The dynamic microphone unit 100 is thus a unidirectional dynamic microphone unit which has satisfactory unidirectionality to prevent howling.

The dynamic microphone unit according to the present invention has the communication passage for sound waves short-circuiting and substantially defeating the acoustic mass in the magnetic gap, which can prevent the resonance between the acoustic capacitance and the acoustic mass in the second air chamber behind the voice coil, and can provide satisfactory flat frequency characteristics without resonance peak over a wide range from low frequency to high frequency.

A dynamic microphone includes the typical dynamic microphone unit described above and a microphone case accommodating the typical dynamic microphone unit, the microphone case having a microphone connector for transmitting output signals to the outside.

What is claimed is:

1. A dynamic microphone unit comprising:

a diaphragm vibrating in response to sound waves;

a voice coil fixed to the diaphragm and vibrating in cooperation with the diaphragm;

a magnetic circuit comprising an inner yoke, an outer yoke and a pole piece, the magnetic circuit generating a magnetic field in a magnetic gap, and the voice coil being disposed in the magnetic gap;

a first air chamber adjacent to a reverse of the diaphragm and holding an acoustic resistance therein;

a second air chamber behind the voice coil; and a communication passage for sound waves between the first air chamber and the second air chamber, the communication passage comprising a groove provided on the inner yoke, wherein the magnetic gap is defined between an inner circumference wall of the outer yoke and an outer circumference wall of the pole piece, wherein the magnetic circuit comprises a magnet surrounded by a ring spacer, wherein the ring spacer has a notch on an outer circumference wall of the ring spacer, the notch is in communication with the communication passage, and wherein the groove is in communication with the notch.

2. The dynamic microphone unit according to claim 1, wherein the inner yoke has a center hole, and the groove extends in the radial direction on the surface of the inner yoke such that the outer circumference wall of the inner yoke is in communication with the center hole.

3. The dynamic microphone unit according to claim 1, wherein the ring spacer has an inner circumference wall, the inner circumference wall is in contact with an outer circumference wall of the magnet, and the outer circumference wall is in contact with an inner circumference wall of a body frame.

4. A dynamic microphone comprising:

a dynamic microphone unit comprising:

a diaphragm vibrating in response to sound waves;

a voice coil fixed to the diaphragm and vibrating in cooperation with the diaphragm;

a magnetic circuit comprising an inner yoke, an outer yoke and a pole piece, the magnetic circuit generating a magnetic field in a magnetic gap, and the voice coil being disposed in the magnetic gap;

a first air chamber adjacent to a reverse of the diaphragm and holding an acoustic resistance therein;

a second air chamber behind the voice coil; and a communication passage for sound waves between the first air chamber and the second air chamber, the communication passage comprising a groove provided on the inner yoke, wherein the magnetic gap is defined between an inner circumference wall of the outer yoke and an outer circumference wall of the pole piece, wherein the magnetic circuit comprises a magnet surrounded by a ring spacer, wherein the ring spacer has a notch on an outer circumference wall of the ring spacer, the notch is in communication with the communication passage, and wherein the groove is in communication with the notch; and a microphone case accommodating the dynamic microphone unit therein.

* * * * *